United States Patent [19]

Jordan et al.

[11] 3,946,920

[45] Mar. 30, 1976

[54] VACUUM SYSTEM CONTROL

[75] Inventors: William E. Jordan, Penfield; Edward L. Steiner, Macedon; Kenton W. Fiske, Fairport, all of N.Y.

[73] Assignee: Xerox Corporation, Stamford, Conn.

[22] Filed: Feb. 22, 1974

[21] Appl. No.: 444,921

[52] U.S. Cl. ..... 226/39; 226/43; 226/45; 226/195

[51] Int. Cl.[2] ..... B65H 23/18

[58] Field of Search ..... 198/184, 208; 226/34, 39, 226/95, 195, 43, 45, 46, 47, 11, 37, 170; 242/75.2, 185

[56] References Cited

UNITED STATES PATENTS

| | | | |
|---|---|---|---|
| 3,302,900 | 2/1967 | Messamer | 242/185 |
| 3,310,249 | 3/1967 | Bryer | 242/185 |
| 3,741,116 | 6/1973 | Green | 226/95 X |

*Primary Examiner*—Richard A. Schacher

[57] ABSTRACT

A control system for one or more vacuum holddown devices for use in an apparatus employing flexible web material in a flattened condition. A plurality of perforated plenums are joined to a manifold connectible to a vacuum producing means. The pressure within the manifold is sensed and must be at a predetermined pressure before the drive system for the web material is activated thereby preventing bulging or buckling of the web material during startup and normal running of the material.

8 Claims, 6 Drawing Figures

VACUUM SYSTEM CONTROL

This invention relates to control system for belt assemblies and particularly, to improvements in vacuum control of one or more vacuum holddown devices for an endless photoreceptor belt. The vacuum holddown devices arranged in accordance with the present invention are particularly adapted for use with selenium belts in automatic reproducing machines that are constructed for high speed operation and require runs of the belt that are flat for specific processing action.

The present invention is particularly adapted for use in the printing apparatus disclosed in U.S. Pat. No. 3,730,623, wherein a belt module is utilized to support a photoreceptor belt for movement. It has been found during the use of such apparatus for high speed copying or duplicating that a belt run whereat a processing function is to occur must be placed in a flattened condition in order to insure evenness and the precise positioning of the plane of the belt run. For example, at the exposure station for the belt module, the portion of the belt continuously moving past this station must be flat and precisely located in the image plane for the printing apparatus. Similarly, at the developing station, the belt run must be precisely positioned and evenly maintained relative to electrical potential sources. At a cleaning station, the precise and even positioning of a belt run insures efficient pre-cleaning and cleaning of the photoreceptor. The use of vacuum plenums for one or more of the processing stations has provided a very efficient means for producing the needed flatness and accurate positioning of belt runs whereever needed. However, the positioning of processing devices along belt runs has also instituted the prospect of damage to the photoreceptor. Such processing devices as corona generating means, magnetic brush rollers or developing cascading means, cleaning rollers or webs, lamps, etc., all have structural elements which, by virtue of their functioning, are positioned in very close proximity to the delicate surface of the photoreceptor. As the belt is driven around its supporting roller, there is a tendency for the belt to bulge out or buckle slightly at its straightaway belt runs. This undesirable effect occurs especially at belt movement startup when inertial forces are greatest. Such bulging out or buckling, even for slight distances can cause contacting of the photoreceptor with structural elements of the processing devices and to cause damage to the photoreceptor.

Therefore, it is the principal object of this invention to prevent intolerable movement of belt runs beyond limits wherein the belt runs will contact nearby structural elements. Another object of the invention is to prevent starting movement of a photoreceptor belt or web in a printing machine, or to terminate its movement in the event belt damaging contact with surrounding structure may ensue.

These and other objects of this invention are obtained by means of a control system arranged to insure that a perforated plenum to which a belt run is applied has a vacuum associated with it of sufficient pressure as to maintain the belt run thereagainst at all times during belt movement around its supporting and driving rollers. The control system also serves as an interlock arrangement which prevents movement of the belt during machine start-up until there is vacuum condition in the vacuum plenum and that it is of sufficient pressure to maintain belt runs away from interfering structure.

For a better understanding of the invention as well as other objects and further features thereof, reference is had to the following detailed description of the invention to be read in conjunction with the accompanying drawings wherein.

Figure 1:
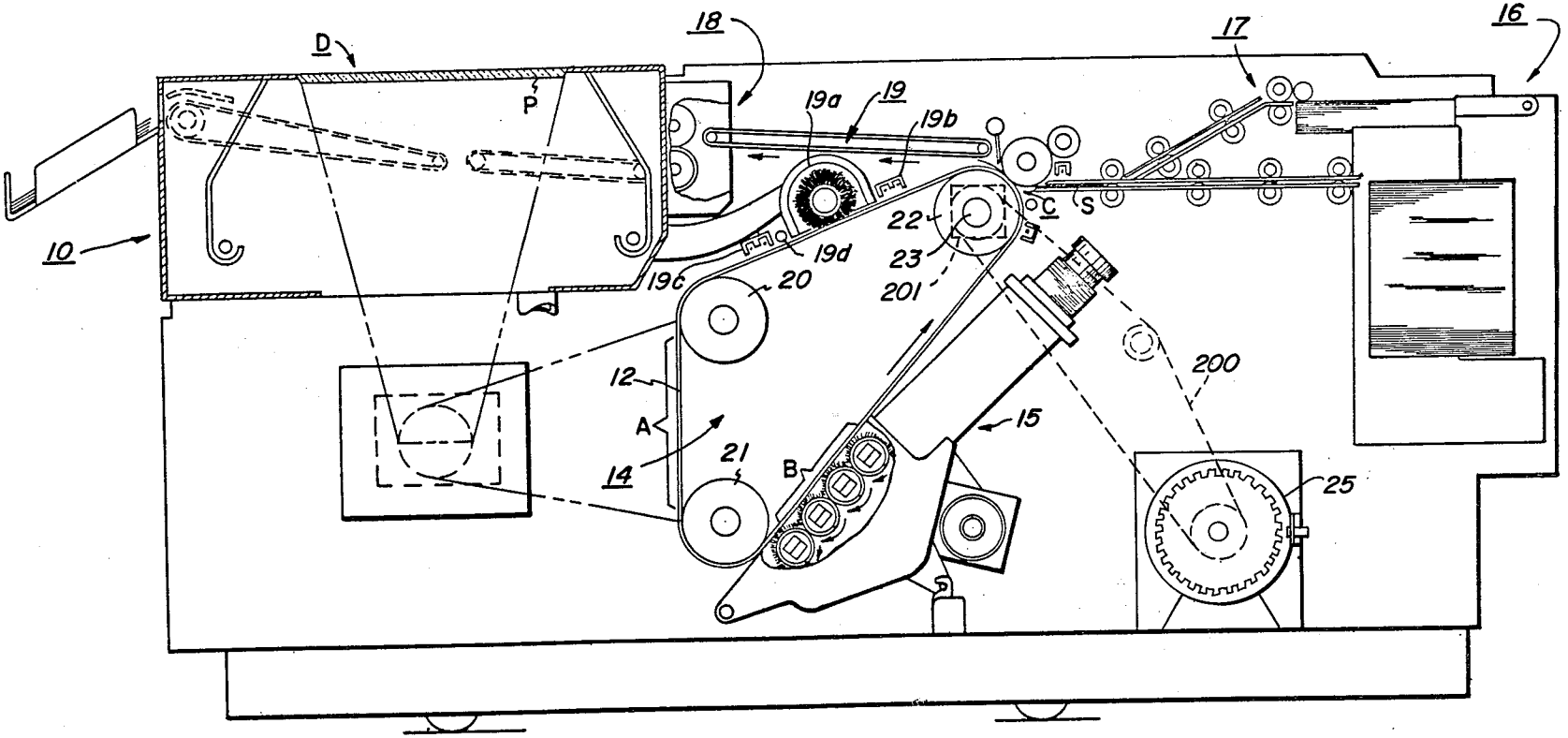
FIG. 1 is a schematic sectional view of an electrostatic reproduction machine showing its various processing stations and into which the present invention may be incorporated.

For a general understanding of the illustrated copier/reproduction machine, in which the invention may be incorporated, reference is had to FIG. 1 in which the various system components for the machine are schematically illustrated. It is to be understood that the illustrated type of machine is utilized only for descriptive purposes and not as a limiting factor in the application of the invention. As in all electrostatic systems such as a xerographic machine of the type illustrated, a light image of a document to be reproduced is projected onto the sensitized surface of a xerographic plate to form an electrostatic latent image thereon. Thereafter, the latent image is developed with an oppositely charged developing material to form a xerographic powder image, corresponding to the latent image on the plate surface. The powder image is then electrostatically transferred to a support surface to which it may be fused by a fusing device whereby the powder image is caused permanently to adhere to the support surface.

In the illustrated machine, an original D to be copies is placed upon a transparent support platen P fixedly arranged in an illumination assembly generally indicated by the reference numeral 10, arranged at the left end of the machine. While upon the platen, an illumination system flashes light rays upon the original thereby producing image rays corresponding to the informational areas on the original. The image rays are projected by means of an optical system for exposing the photosensitive surface of a xerographic photoreceptor in the form of a flexible photoconductive belt 12 arranged on a belt assembly generally indicated by the reference numeral 14.

As will be described below, the photoreceptor belt 12 is adapted to be driven in the direction of the arrow at a constant rate. During this movement of the belt, the reflected light image of an original on the platen is flashed upon the photosensitive surface of the belt to produce electrostatic latent images thereon at an exposure station A.

As the belt surface continues its movement, the electrostatic image passes through a developing station B in which there is positioned a developer assembly generally indicated by the reference numeral 15 and where the belt is maintained in a flat condition. The developer assembly 15 provides development of the electrostatic image by means of multiple magnetic brushes as the same moves through the development zone B.

The developed electrostatic image is transported by the belt to a transfer station C whereat a sheet of copy paper is moved between a transfer roller and the belt at a speed in synchronism with the moving belt in order to accomplish transfer of the developed image solely by the electrical bias of the transfer roller. There is provided at this station a sheet transport mechanism generally indicated at 16 adapted to transport sheets of paper from a paper handling mechanism generally indicated by the reference numeral 17 to the developed image on the belt at the station C.

After the sheet is stripped from the belt 12, it is conveyed into a fuser assembly generally indicated by the reference numeral 18 wherein the developed and transferred xerographic powder image on the sheet material is permanently affixed thereto. After fusing, the finished copy is discharged from the apparatus at a suitable point for collection externally of the apparatus. Any untransferred residual image or toner particles remaining on the belt 12 after leaving the transfer station C is removed from the belt by a cleaning device 19 which comprises a rotating cleaning brush, a housing 19*a* for containing the same; and a pre-clean corona generating device 19*b*. Mounted on the housing 19*a* for support thereby is the charging corona generating device 19*c* for the machine and a flood lamp 19*d* which is utilized to discharge the belt 12 before recharging thereof by the device 19*d*.

Drive means is arranged to drive the selenium belt 12 in conjunction with timed flash exposure of an original to be copied, to effect image development, to separate and feed sheets of paper and to transport the same across the transfer station C and to convey the sheet of paper through the fuser assembly in timed sequence to produce copies of the original.

The belt 12 comprises a photoconductive layer of selenium which is the light receiving surface and imaging medium for the apparatus, on a conductive backing. The belt is journaled for continuous movement upon three rollers 20, 21, and 22 located with parallel axes at approximately the apex of a triangle. During exposure of the belt 12, the portion thereof being exposed is that part of the belt run between the upper roller 20 and the lower roller 21.

The upper roller 22 is rotatably supported on a shaft 23 journaled in two side plates, not shown, which also support for rotation the rollers 20 and 21. The shaft 23 projects into the machine and is drivingly connected to a drive mechanism 25 as will be described below. Further details of the belt assembly and supporting and cooperating structure are not necessary to understand the present invention. Such further details may be found in the above cited U.S. Pat. No. 3,730,623 the description of which is hereby incorporated by reference.

Figure 2:
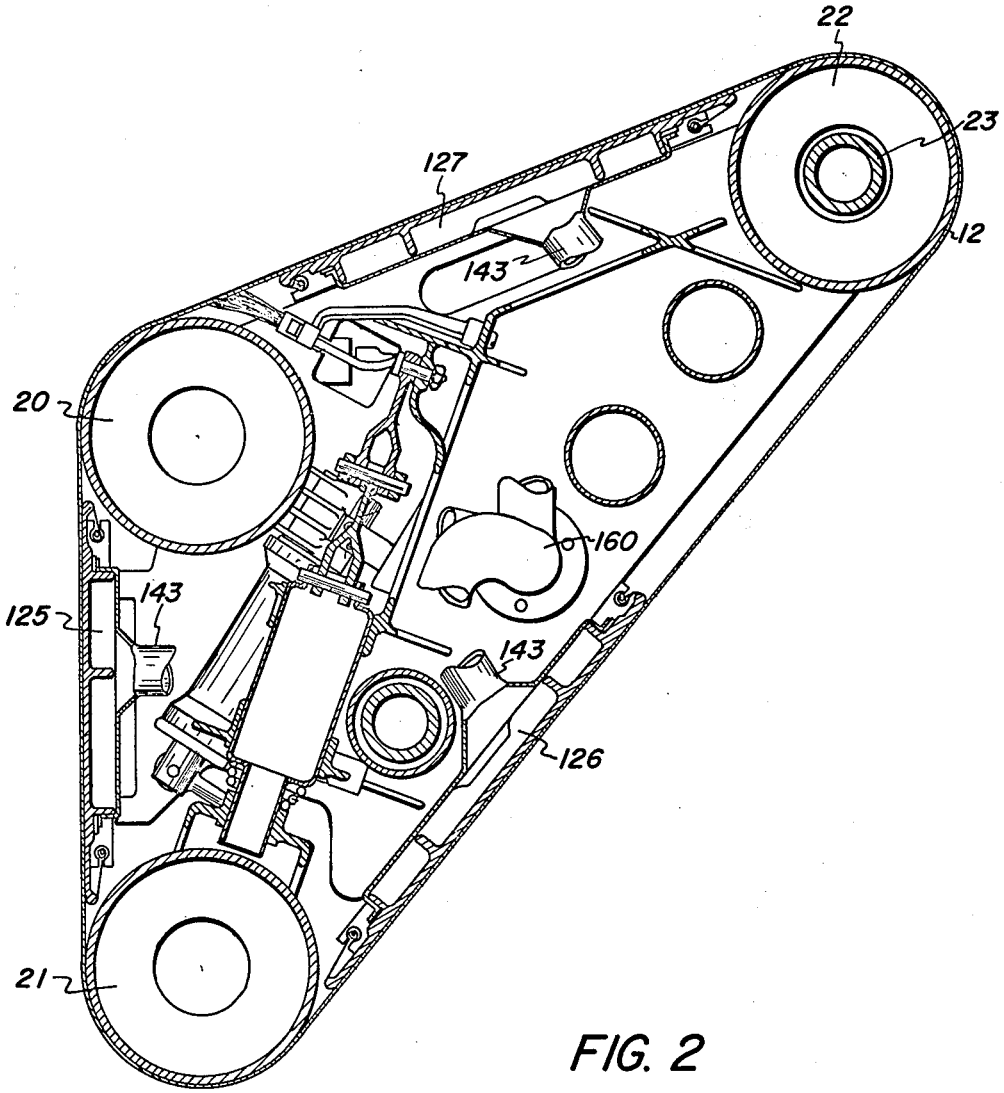
FIG. 2 is a partial cross-sectional view of a belt assembly as seen from the front of the machine.

As shown in FIG. 2, the belt assembly is in a form which provides three belt runs; that is, sections of the belt that lie in flat predetermined planes. In order to provide runs which are truly flat and which insure the positioning of a belt run in a precisely located plane, free of vibration inadvertent deflection and which will assume the working position at all times, the belt assembly is provided with a flat holddown device for each of the runs. To this end, the exposure belt run, that is, the run between rollers 20, 21 has associated therewith a holddown device 125, the development run between the rollers 21, 22 has the holddown device 126, and the cleaning run between the rollers 20, 22 has the holddown device 127. Since each of the devices are the same, except for size, only one, the development holddown device 126 will be described below.

Figure 4:
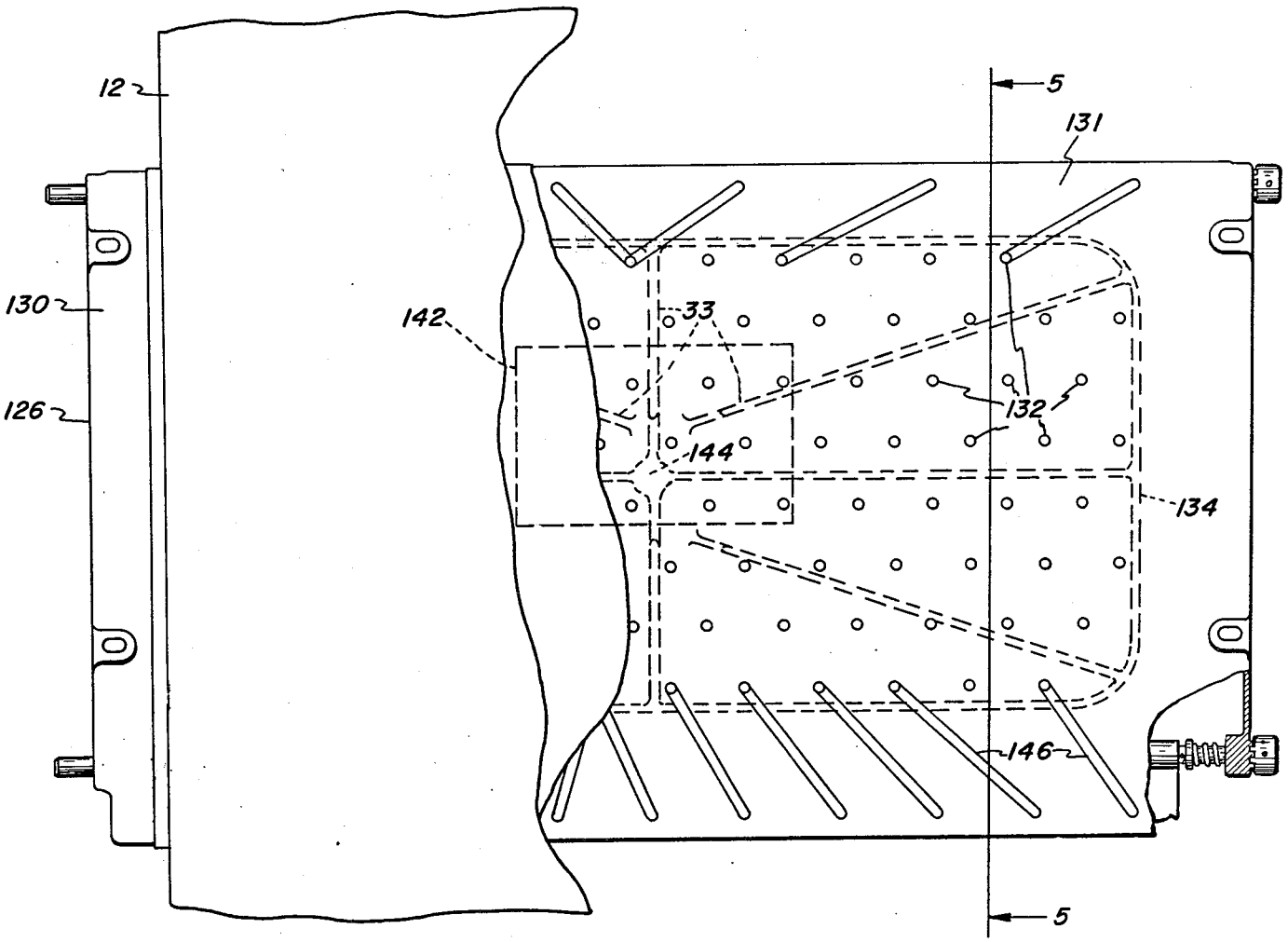
FIG. 4 is a plan view, partly broken away of a vacuum holddown device.
Figure 5:
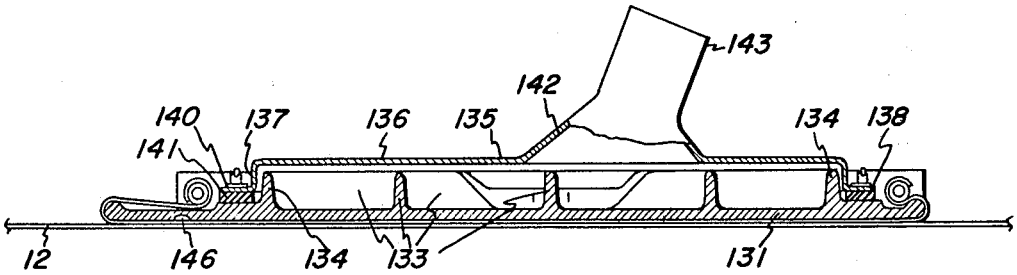
FIG. 5 is a sectional view taken along lines 5—5 in FIG. 4 showing the holddown device in an inoperative condition.

As shown in FIGS. 4 and 5, the vacuum holddown device 126 comprises a vacuum plenum 130 having a flat surface plate 131 formed therethrough with many openings 132 upon which the photoreceptor belt 12 is stretched across during movement thereof. On the other side of the plate away from the belt 12, the plenum includes a plurality of ribs 33 made integral with plate and projecting from the surface thereof. Along the ribs, there is also integrally formed on the same side of the plate 131 a circumferential guard wall 134 which is connected to the exterior ends of all the ribs 33 and also which surrounds all of the openings 132.

The spaces between the ribs 33 and the circumferential wall 134 are closed off on that side of the plate 131 by a manifold 135 made of flexible plastic material and having a relatively flat web portion 136 positioned to span across all of the ribs and the wall 134. The outer circumferential edge of the manifold 135 is formed with a wall 137 which extends toward the plate 131 and completely surrounds the wall 134. The wall 137 terminated in a flange 138 which is secured to the adjacent surface of the plate 131 by suitable lock washers 140. In order to insure a vacuum seal within the interior chamber defined by the flat portion 136 of the manifold 135 and the plate 131, a circumferential gasket 141 or sealing device is positioned between the flange 138 and the plate. The manifold 135 also includes a chamber formed by outwardly extending wall 142 which terminates in a hose connector 143 to which a hose of an air evacuation system may be secured. The chamber walls 142 extend beyond the plane of the web portion 136 approximately centrally of the plate 131 in order to provide access to all of the spaces between the ribs 33. As shown in FIG. 4, the chamber is in communication with all of the spaces between all of the ribs 33 some of which terminate short of the central core section 144 of the vertical and horizontal ribs as viewed in this figure.

In order to extend the vacuum effectiveness of the holddown device 126, the plate 131 on the side supporting the belt 12 is formed with grooves 146 of semicircular cross-section connected to some of the outer opposed edges of the plate 131. Since air is evacuated out of the space defined by the circumferential wall 134 within which the outermost series of openings 132 are confined, the effect of the vacuum produced by this evacuation of air will be felt at the extreme outer limits of the grooves 146 and along the same. With the belt applied to the outer surface of the plenum plate 131, as shown in FIG. 4, and with the plenum subjected to a vacuum producing system, the belt will be forced against the plate by the resultant pressure differential effected between the spaces on either side of the plate 131. The effect of this force on the belt will extend between the outer ends of the series of grooves 146 on one edge of the plate 131 to the outer ends of the series of grooves at the other edge of this plate.

This force on the belt will be continuous as the same moves on the belt assembly 14 and will produce flattened, unwavering portion of the belt for whatever processing is to occur opposite the holddown device. For the above described holddown device 126, which is the one opposite the developer apparatus 15 and in the development zone B, the belt, during movement thereof, will be maintained in a fixed portion relative to the spacing between itself and the magnetic brushes utilized in the apparatus. As to the vacuum holddown device 125, located in the exposure zone A, the belt, during movement will be fixed relative to the conjugate of the optical axis for the printing machine. Similarly, the holddown device 127, positioned in the cleaning-charging zone, will fix the belt as the same moves for these functions.

Figure 6:
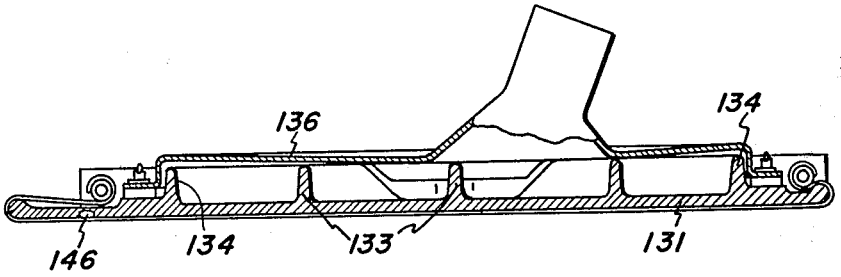
FIG. 6 is a view similar to that in FIG. 5 but showing another condition of operation.

During machine shutdown when a vacuum producing means, which is generally in the form of a blower and duct work, in the printing machine is inoperative, the web 136 for the manifold 135 is in its flattned, unstressed condition as shown in FIG. 5. When the vacuum producing means is rendered operative, air is drawn from the external circuitry of the plenum 131, through the openings 132, through the spaces between ribs 33 and within the wall 134 and out of the chamber 142. With the belt 12 being applied against the plenum 131, a vacuum is produced in these spaces to cause the belt to be drawn under force upon the plate 131 and also to cause the web 136 to flex and be drawn against the adjacent edges of the ribs 33, as shown in FIG. 6. When the web 136 contacts the ribs 33, the atmospheric pressure on both sides of the holddown device equalize and there is no platen deflection. The only load then on the platen is the weight of the platen itself plus the loads of the extraneous processing devices in contact with the belt 12 at this point.

Figure 3:
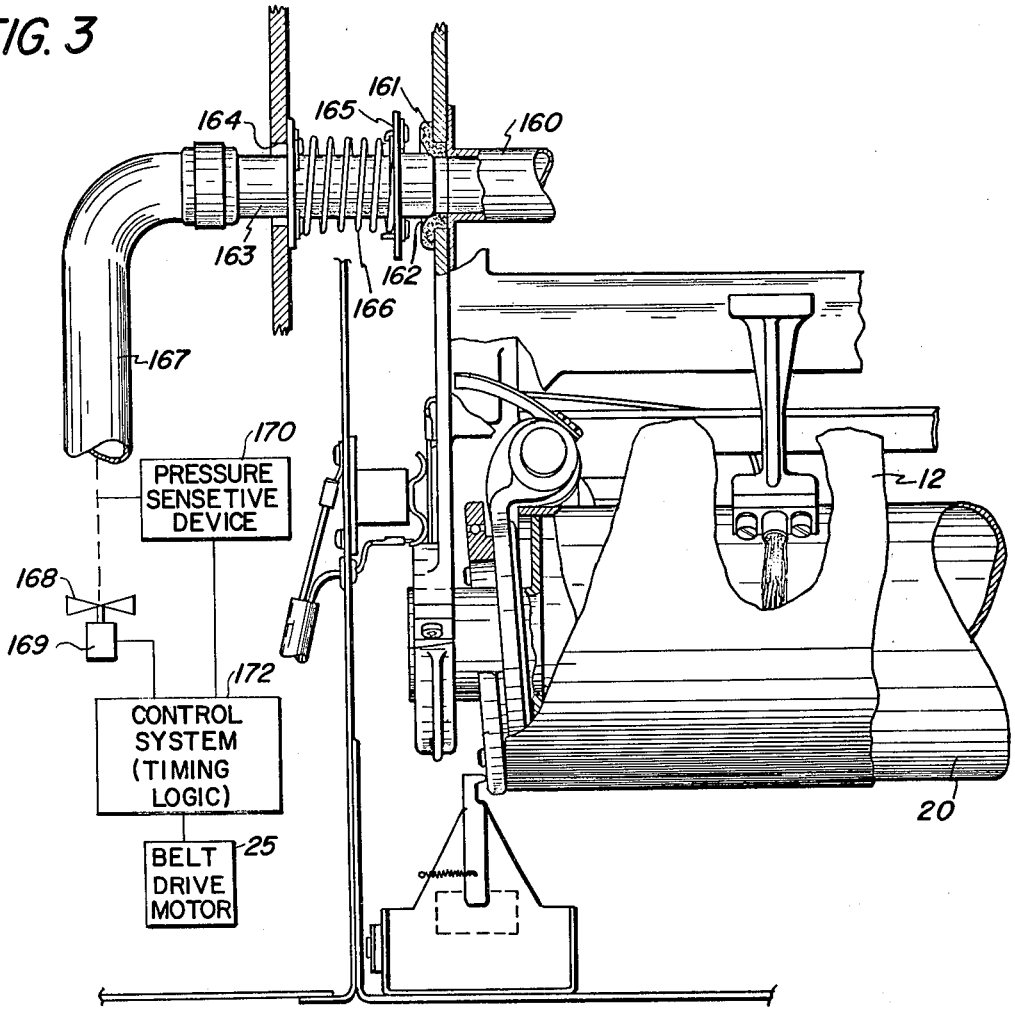
FIG. 3 is a sectional view of a detail of the machine and the control system associated with vacuum holddown device.

As previously stated, the vacuum holddown devices 125, 126 and 127 are structurally and functionally similar. Each is provided with a chamber 142 and a hose connector 143, as shown in FIG. 2. All of these hose connectors are joined together to a common pipe 160 (see FIGS. 2 and 3) which is directed to the one side of the belt assembly. The pipe 160, as disclosed in the above reference U.S. Pat. No. 3,730,623, is connected to a pipe 167 mounted in the machine, which, in turn, is associated with a vacuum blower 168.

The vacuum producing means 168 may be in the form of a blower suitably mechanically connected to a motor 169. Control of the motor 169 in order to accomplish vacuum condition in the vacuum holddown devices, is accomplished by a control arrangement comprising a transducer 170 arranged in the pipe 167. The transducer 170 may be a simple pressure sensitive device adapted to sense pressure differences and to produce a signal indicative of the presence or absence of a specific pressure in the pipe 167. The pressure sensitive device 170 is operatively connected to the control system 172 for the machine which is also operatively connected to the belt drive motor mechanism 25. The vacuum producing means 168 is arranged to produce a vacuum pressure in each of the vacuum plenums associated with the vacuum holddown means 125, 126 and 127 in order to accomplish holding of the belt run against the respective plates 131 and away from the structural elements of the magnetic brush developing apparatus 15, the cleaning device 19 and any other devices utilized during processing of developed images and the reproduction of originals. Therefore, it is necessary that the vacuum produced by the vacuum producing means 168, is effective before movement is imparted to the belt 12 by the drive mechanism 25.

The control system may include the machine control logic and timing system wherein control pulses for machine functioning and processing is generated. A detailed description of such a system is found in the copending application, Ser. No. 445,014 filed on the same date herewith. In the above referred to application, the motor drive mechanism is arranged to generate a train of clock pulses which are in turn utilized to produce operating control signals for the machine. The various machine functions are activated and/or deactivated in timed sequence by the control signals so produced. This system may be incorporated into the presently disclosed machine to be operated in accordance therewith.

As shown in FIG. 1, the drive mechanism 25 is connected by a belt 200 which is drivingly associated with the roller 22 by way of a suitable clutch 201. When the machine is turned "ON" to its initiating warm-up condition, the drive mechanism is activated and allowed to achieve its full operating posture by means of the machine control system 172. This system also initiates activation of the blower motor 169 for causing vacuum conditions in the holddown plenum 125, 126 and 127 and generally to maintain these conditions throughout the time that the belt mechanism is activated.

The control system 172 is arranged to inhibit activation of the clutch 201 for connecting belt drive mechanism 25 to the belt drive roller 22 until the pressure within each of the holddown devices is sufficient to effect holding of the belt runs against each of the holddown devices. Upon attaining this pressure, whereat the belt runs will be held against contacting structural elements of processing devices spaced along the belt movement path, a signal is generated by the pressure sensitive device 170 as a control input to the control system 172. This input then places the clutch 201 for the drive mechanism in condition to be activated when its own control signal is effectively introduced. In the event, the pressure within the holddown devices becomes insufficient for holddown purposes, the control system 172 is arranged to shut down the drive mechanism until such time as the pressure becomes sufficient. The control system is also adapted to permit the continual activation of the blower motor 169 until the clutch 201 for the drive mechanism 25 has become deactivated, such for example, during machine shutdown at the end of a production run or in the event of machine malfunctioning. Another alternative to this arrangement which does not include a clutch such as clutch 201 would involve simply an "on-off" switching system for the drive mechanism 25. When the machine is turned "ON" only the blower motor is energized initially. After pressure in the holddown device is achieved, the drive mechanism can then be energized.

As a further alternative to the control of the machine, instead of the pressure sensing device, machine interlock switches (not shown) generally provided in such machines may be used. Typically, such a machine includes series connected interlock switches operatively coupled to the machine door and/or covers, or any other machine devices needing interlock service. The covers are generally raised as access means so that the operator can get at the interior of the machine to remove jammed paper sheets or rectify other malfunction conditions. The interlock switches may also be connected in series with switches operatively coupled to the platen cover that covers the document originals being flash imaged.

The control means is adapted to sense the opening and closing of the series connected switches to produce an output signal that signifies whether or not anyone or more of the machine covers and/or platen covers are properly closed. The control means is designed so that it will start the blower motor only when it detects proper closing of the interlocks and/or the platen cover and then after a predetermined period of time delay to allow the motor to build the necessary level of vacuum pressure, it energizes the machine drive motor to start driving the belt of flexible photoreceptor. This alternative takes the advantage of the pre-existing means, i.e. interlocks, in controlling the operation of the blower motor and the machine drive motor.

From the foregoing description of the belt assembly vacuum producing arrangement in conjunction with the machine logic and timing control system, it will be appreciated that an effective means has been devised for protecting the sensitive and delicate surface of a moving flexible photoreceptor from surrounding elements which are closely spaced relative thereto. The invention, however, has broader aspects than for application to a flexible photorecptor of the form herein disclosed. For instance, rather than for use with an endless belt, the above control arrangement may also be applicable to a web material which is fed from a supply roll and taken up in a take-up roll, or which is associated with mechanisms adapted to discard spent parts and effectively function as an endless belt with a supply source.

The invention may also be applied to endless conveyor belts which have means thereon for retaining smaller segments after certain number of uses thereof. For an even broader aspect, the present invention need not be limited to photosensitive material or segments thereof. The present invention may be useful for any belt or flexible web member system being driven by a drive mechanism. To protect the belt or web member or any element thereon from contacting surrounding or adjacent structures, vacuum plenums may be employed for precisely positioning belt runs, and, as in accordance with the present invention, the pressure in the plenum may be made to control activation of the drive mechanism.

While the invention has been described with reference to the structure disclosed, it is not confined to the details set forth; but is intended to cover such modifications, or changes as may come within the scope of the following claims.

We claim:

1. In an apparatus utilizing web material arranged to be moved in a path having at least one run adjacent a vacuum holding device which, when in vacuum condition, is adapted to hold said web run thereagainst, and a drive mechanism for driving said web material in its path of movement, the improvement including, a control system coupled to said holding device and said drive mechanism, said control system including means for measuring pressure within said holding device, said control system activating said drive mechanism when said pressure within said vacuum holding device is at a predetermined value.

2. In an apparatus utilizing web material arranged to be moved in a path having at least one run adjacent a vacuum holding device which, when in vacuum condition, is adapted to hold the web run thereagainst, and a drive mechanism for driving the web material in its path of movement, the improvement including, a control system coupled to said holding device and said drive mechanism, said control system including means for measuring pressure within said vacuum holding device, said control system deactivating said drive mechanism during operation thereof when said pressure within said vacuum holding device falls below a predetermined value.

3. In an apparatus utilizing web material arranged to be moved in a path, having holding means for holding at least one run of said material in a flat predetermined position and a drive mechanism for driving said web material in its path of movement, the improvement including, a control system coupled to said holding device and said drive mechanism, said control system including means for sensing force exerted by said holding means on said run of material said control system activating said drive means when said holding means is effective to hold said run of material in said predetermined plane.

4. In a printing system having processing stations, a moving flexible web material adapted to convey one or more printing areas adjacent to said stations for processing thereby, means for producing at least one run of said web material, and a drive mechanism associated with the web material for imparting movement thereto, the improvement comprising, a vacuum holddown device arranged opposite said web run for continuously holding the belt run in a substantially flat condition and in a predetermined plane, and control means coupled to said holddown device and to said drive mechanism, said control means including means for measuring pressure in said vacuum holddown device, said control means activating said drive mechanism when the pressure within said holddown device is at a predetermined value.

5. In a printing machine having processing stations, a moving flexible web material adapted to convey one or more printing areas adjacent to said stations for processing thereby, means for producing at least one run of said web material, and a drive mechanism associated with said web material for imparting movement thereto, the improvement comprising, a vacuum holddown device arranged opposite said web run for continuously holding said web run in a substantially flat condition and in a predetermined plane, and control means coupled to said holddown device and said drive mechanism, said control means including means for measuring pressure in said holddown device, said control means deactivating said drive mechanism during operation thereof when said pressure within said holddown device falls below a predetermined value.

6. In a printing machine having processing stations, a moving flexbile web material adapted to convey one or more printing areas adjacent to said stations for processing thereby, means for producing at least one run of said web material, and a drive mechanism associated with said web material for imparting movement thereto, the improvement comprising, means for holding said belt run in a substantially flat condition and in a predetermined plane during movement of said web material and control means coupled to said holding means and said drive mechanism, said control means including means for measuring a force exerted by said holding means, said control means activating said drive mechanism when said holding means force is effective to hold said run of material in said predetermined plane.

7. In a printing machine having at least one processing station, a moving flexible web material adapted to convey one or more printing area to a position adjacent said station for processing thereby, means for producing at least one run of said web material and a drive mechanism associated with said web material for impacting movement thereto, the improvement comprising, means for holding said web run in a substantially flat condition and in a predetermined plane, and control means coupled to said holding means and said drive mechanism, said control means including means for measuring a force exerted by said holding means on said web material, said control means deactivating said drive mechanism during operation thereof when said holding means force is ineffective in holding said web run in said predetermined plane.

8. In an apparatus utilizing web material arranged to be moved in a path having at least one run adjacent a vacuum holding device which, when in vacuum condition, is adapted to hold the web run thereaginst, and a drive mechanism for driving the web material in its path of movement, the improvement comprising:

means for producing a vacuum condition in said holding device; and a control system coupled to said vacuum producing means and said drive mechanism, said control system including a means for sensing a vacuum produced by said vacuum producing means and including a timing means, said control system activating said drive mechanism after a predetermined time period after said vacuum sensing means has measured said vacuum above a preselected value.

* * * * *